US006321559B1

(12) United States Patent
Guerra

(10) Patent No.: US 6,321,559 B1
(45) Date of Patent: Nov. 27, 2001

(54) EVAPORATIVE SNOW APPARATUS

(76) Inventor: Francisco Javier Guerra, 9715 W. Broward Blvd. #217, Plantation, FL (US) 33324

( * ) Notice: Subject to any disclaimer, the term of this patent is extended or adjusted under 35 U.S.C. 154(b) by 0 days.

(21) Appl. No.: 09/664,271

(22) Filed: Sep. 18, 2000

(51) Int. Cl.[7] ..... F25C 1/00
(52) U.S. Cl. ..... 62/347; 239/2.2
(58) Field of Search ..... 62/347; 239/2.2

(56) References Cited

U.S. PATENT DOCUMENTS 4,813,598 * 3/1989 Kosik, Sr. et al. ..... 239/2.2
4,901,920 * 2/1990 Wollin ..... 239/2.2
5,180,106 * 1/1993 Handfield ..... 239/2.2
5,887,791 * 3/1999 Rothe ..... 239/2.2
5,961,041 * 10/1999 Sekihara et al. ..... 239/2.2

* cited by examiner

*Primary Examiner*—William E. Topolcai
*Assistant Examiner*—Mohammad M. Ali
(74) *Attorney, Agent, or Firm*—David W. Barman

(57) ABSTRACT

A Machine and method for producing the illusion of snow is disclosed and described. It produces said product in a manner such that is easier to manufacture, operate, and produce than is currently available.

7 Claims, 2 Drawing Sheets

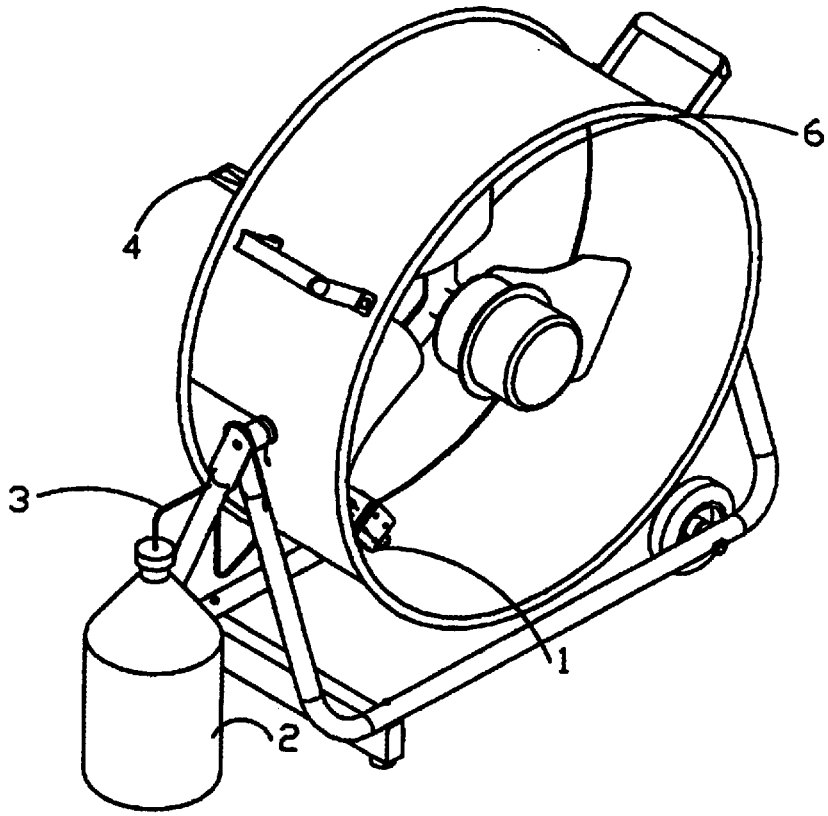
FIG 1
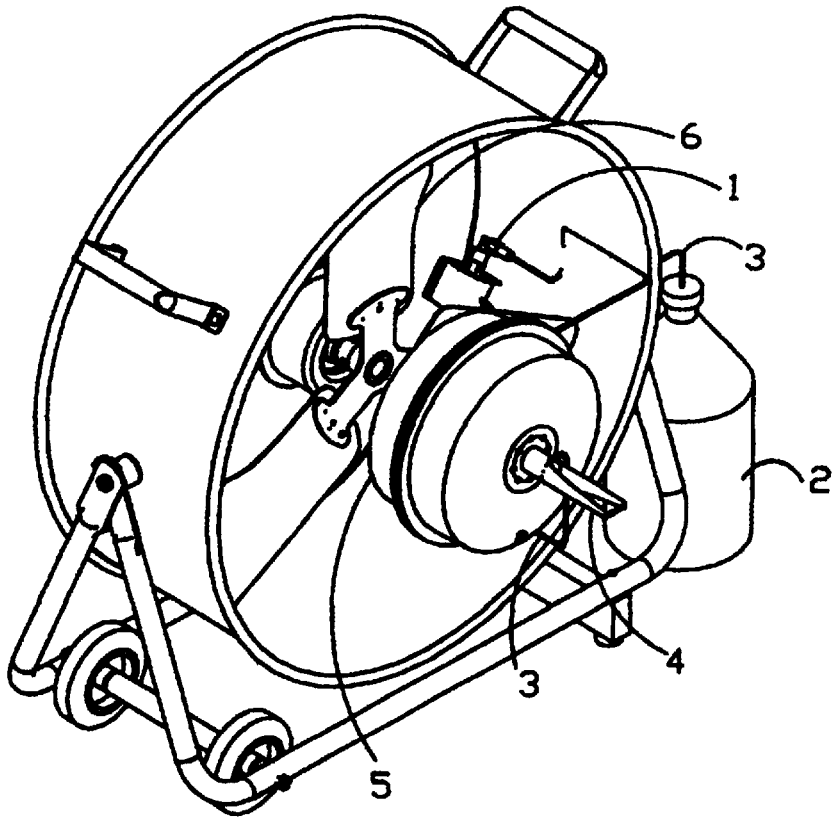

EVAPORATIVE SNOW APPARATUS

FIELD OF THE INVENTION

This invention relates to the production of evaporative snow. More particularly, a machine which capable of creating the illusion of snow for theatrical or special effect purposes without the use of refrigeration, and without causing the accumulation of any residual moisture in the area in which it is used.

BACKGROUND OF THE INVENTION

The world of theater and special effects has prided itself on the ability to create illusions. The masters of this art are continually creating their magic for the entertainment of their patrons. One of the most challenging illusions is that of snow. This presents a distinct difficulty. Limitations based on temperature and accumulation of moisture have always plagued the special effects creators.

There are many commercially available machines for producing snow. Many of these liquid based snow machines have been able to produce artificial snowflakes. The flakes formed were tight groupings of bubbles that were moist and had a tendency to clump together. This caused difficulty in dissipation. Additionally, there were concerns regarding moisture buildup in the area in which the machine was used. The problems of slippery floors, surfaces, and staining from the product have not been overcome. In an attempt to overcome these problems, people have attempted the use of fans in order to more widely distribute the artificial snow produced by these earlier machines. However, the flakes tend to form agglomerates which are not substantially effected by the auxiliary fans. These auxiliary fans do not overcome the physical difficulty of moisture buildup or the danger, which it presents.

The current invention overcomes these deficiencies. It provides for the creation of evaporative snow by an apparatus that utilizes a solution, which is commercially available as FG-100 Evaporative Snow (manufactured by Snow Masters, Plantation Fla.) drawn into a turbulent carrier wave of air at the same point at which the flakes are produced. The preciseness of placement of the carrier wave prevents tight clumps from forming, and causes greater separation between the flakes. Once the individualized flakes are carried from the machine, the evaporative process occurs and prevents moisture buildup.

BRIEF DESCRIPTION OF THE DRAWINGS

FIG. 1 shows a complete illusionary snow machine that incorporates all of the aspects of the invention.

DETAILED DESCRIPTION OF TIBE PREFERRED EMBODIMENT

Figure 2:
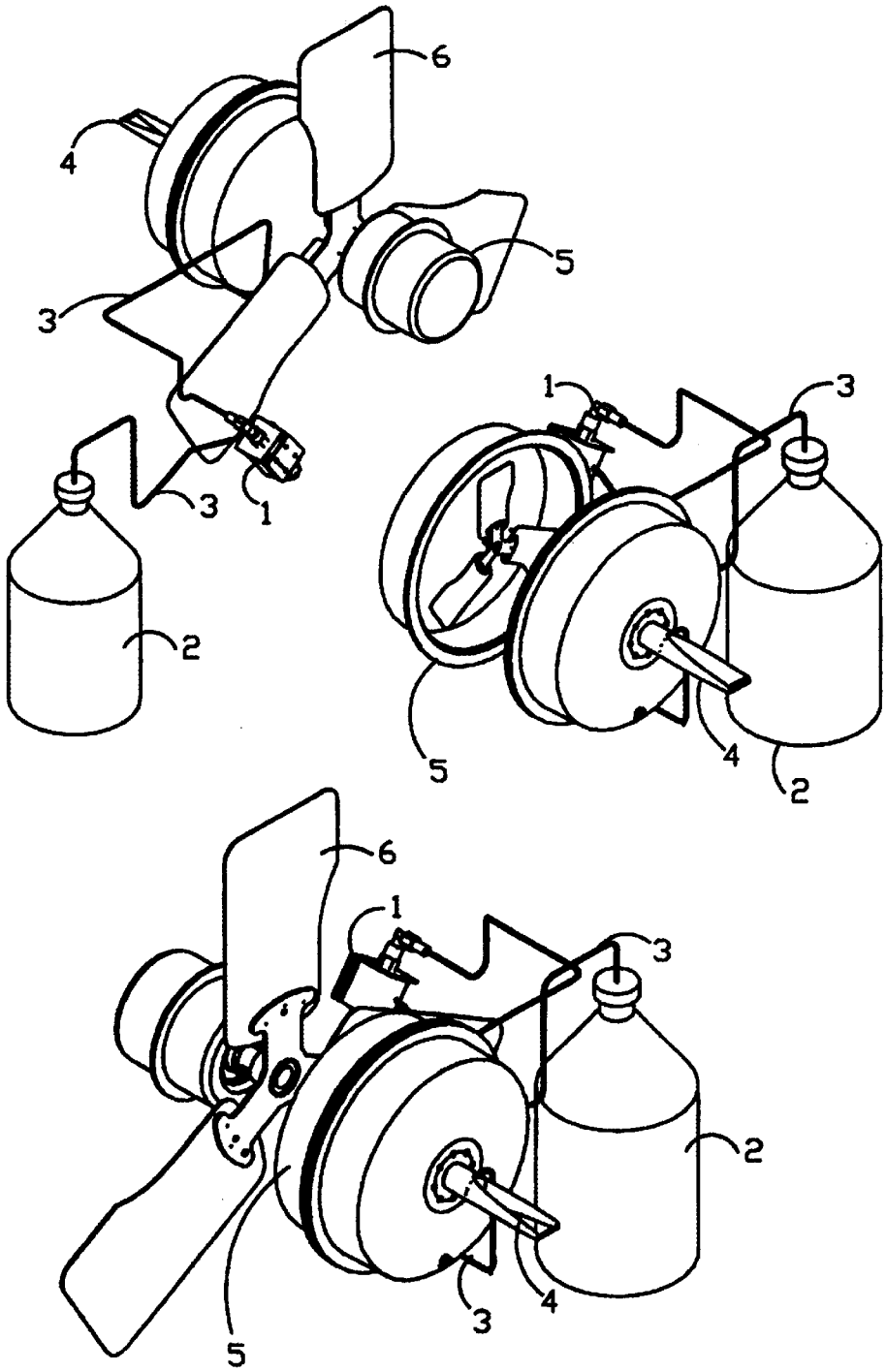
FIG. 2 illustrates the pump with connecting hose and the flake generator.

The evaporative snow solution 2 under pressure is drawn into connecting hose 3 by means of an in-line liquid pump 1 at a rate of 4 ounces per minute. The liquid then continues to a flake generator 7 where it saturates a sock 4. An impeller 5 contained within flake generator 7 causes flakes to form and to be projected into the air while an integrated carrier fan 6 facilitates the distribution of individual flakes. The flake generator 7 will produce a constant 3000 cubic feet per minute of airflow. This volume of air is forced through sock 4 and holes 8, which are on the outer surface of flake generator 7. Pressure of the air coming through sock 4 causes flakes to be formed on the outer surface of said sock 4. The volume of air produced by impeller 5 that exits flake generator 7 through the holes 8 lift the flakes from the surface of sock 4. Once the flakes are lifted from sock 4, they are projected away from the apparatus by means of airflow produced by carrier fan 6. When the force of air contacts the flakes produced carrier fan 6 there are two physical phenomena that occur. First the flakes are broken into smaller particles. This is a novel part of the current invention. The other commercially available machines have a great tendency to produce larger agglomerates, which in turn lead to excessive moisture buildup in the surrounding area. Second, once the flakes are separated into smaller particles, they are more easily dispersed in the area away from the machine. Once they are in the air in this matter the overall ratio of surface area exposed to air greatly increases. With this increased surface are comes a greater ability to speed the evaporative process. These two factors combine to speed the evaporative process and make it more complete. Another novelty of the current invention lies in the design of carrier fan 6 being lined up with flake generator 7 to lift the flakes and eject them from the apparatus in a manner that is greatly increased then a machine that would not contain both of these features placed together and at a proper distance from one another. This allows the flakes to remain in the air for a longer period of time and thus increases the transit time before they reach the ground. This increased time provides more exposure to air and allows for the completeness of evaporation to occur. The final result is an evaporative artificial snowfall that is truly free from residue of any type. Additionally, the snow produced does not resemble typical artificial snow that is ejected from a carrier hose or other apparatus. The current invention lifts the evaporative snow in a manner that produces a gentle cloud of snow in a wider horizontal area. The individualized flakes provide a cloud of gently falling flakes that is truly more realistic than anything currently available.

What is claimed is:

1. A machine for producing an evaporative snow as small individualized particles which are easily dispersed, are free from agglomerates and leave no moisture or residue in the area of use, said machine comprising a pump to deliver an evaporative snow solution to a flake generator, said flake generator comprising an impeller which causes flakes to form on the surface of a sock, said flakes are dispersed from said sock by a carrier fan.

2. The machine of claim 1 in which the pump operates at a rate of 4 ounces per minute.

3. The machine of claim 1 in which the impeller lifts the evaporative snow off said sock.

4. The machine of claim 1 in which the carrier fan disperses the evaporative snow into an area away from the machine.

5. The machine of claim 4 in which said carrier fan is employed to increase the fall time of the evaporative snow and allow for evaporation.

6. The machine of claim 1 in which said carrier fan is placed at a distance from the flake generator such that the flake generator provides for the removal of the evaporative snow from the sock.

7. A method for producing an evaporative snowfall which employs an evaporative snow solution, said method comprising the steps of:

drawing said evaporative solution into an apparatus through a hose, which is connected to a pump, directing said solution from said pump to a flake generator, which forms flakes on the outer surface of a sock, and projecting the flakes away from the sock means of airflow produced by a carrier fan.

* * * * *